United States Patent [19]

Claxton

[11] Patent Number: 4,592,658

[45] Date of Patent: Jun. 3, 1986

[54] MATERIAL ENTRAINMENT AND CIRCULATION IMPELLER AND METHOD FOR SUBMERGING AND ENTRAINING MATERIAL IN A MEDIA

[76] Inventor: Raymond J. Claxton, 7123 Lyre La., Dallas, Tex. 75212

[21] Appl. No.: 653,902

[22] Filed: Sep. 25, 1984

[51] Int. Cl.[4] ..... B01F 5/12

[52] U.S. Cl. ..... 366/265; 416/188

[58] Field of Search ..... 366/263, 265, 262, 264; 416/179, 183, 185, 188; 415/206

[56] References Cited

U.S. PATENT DOCUMENTS

| | | | |
|---|---|---|---|
| 865,030 | 9/1907 | Forbes | 366/263 |
| 2,738,174 | 3/1956 | Magnant | 366/263 |
| 3,128,084 | 4/1964 | Castor | 366/265 |
| 3,690,621 | 9/1972 | Tanaka | 366/265 |
| 3,961,775 | 6/1976 | Markus | 366/265 |

*Primary Examiner*—Robert W. Jenkins

*Attorney, Agent, or Firm*—Harold A. Wiliamson

[57] ABSTRACT

This invention relates to an apparatus and method that provides by means of circulator/impeller configuration alone the generation of a stabilized vortex in a media wherein the vortex generated is stable in its dynamic formation over a wide range of rotational circulator-/impeller speeds and increasing distances beneath the surface of the media.

The apparatus and method include a charge carrying fluid media in a vessel or other containment device that is redirected within the vessel or containment device by fluid flow, by and through a circulator/impeller such that the fluid is forced to pass through an angle greater than 90 degrees but less than 180 degrees. The redirection being as a result of forces imparted to the fluid by virtue of the inventive geometry of the circulator/impeller and independent of vessel/containment device configuration or nearby wall confinements.

The improved circulator is provided with means to allow a portion of the media to be circulated to be delivered to a region beneath the circulator to thereby flush away foreign objects heavier than the media that may be present beneath the circulator.

52 Claims, 16 Drawing Figures

MATERIAL ENTRAINMENT AND CIRCULATION IMPELLER AND METHOD FOR SUBMERGING AND ENTRAINING MATERIAL IN A MEDIA

TECHNICAL FIELD

This invention relates to an improved material entrainment and circulation impeller and method for submerging and entraining material in a media wherein the material specifically contemplated is scrap aluminum and the media is predominently molten metal.

BACKGROUND OF THE INVENTION

In the recent past there has been a significant increase in the use of aluminum especially in the beverage industry where the employment of aluminum cans has skyrocketed. Over the years there has been a persistent effort by industry to come up with scrap aluminum reclamation apparatus and associated methods that will allow for the continuous recycling of aluminum cans. Typically these recyling approaches have contemplated the reclamation of any and all forms of aluminum scrap, whether the scrap be aluminum cans in a shredded condition or aluminum scrap which has been generated by any one of a number of other manufacturing operations.

The aluminum scrap reclamation industry has always been vexed by the problem of getting submerged in molten metal light weight, thin pieces of scrap that inherently tend to float on the surface of the molten metal into which they must be submerged in order to be most efficiently melted. This general problem of overcoming the inherent tendency of materials to float on the surface of a fluid medium in which the floating materials are to be mixed is faced in fluid mixing environments other than scrap aluminum and molten metal. The apparatus and method to be described hereinafter will find utilization in these other environments.

The advance state-of-the-art in the technical area of aluminum scrap reclamation is best exemplified by the Claxton Pat. Nos. 4,322,245 ('245) and 4,386,764 ('764) which are directed to a method and apparatus for submerging, entraining, melting and circulating a metal charge in a molten media.

Prior to the inventions just noted, most scrap reclamation systems had unwisely included an independent pump to get the molten metal to circulate through the system. The invention of the above noted '245 and '764 patents employed a rotating impeller configured to cause the formation of a vortex in the molten media which in turn caused a charge of scrap to be initially entrained in the media and drawn in a vertically downward direction whereupon the impeller caused the molten media and charge to change from a vertically downward direction to a horizontally outward direction. This impeller action thereby caused the charge to be completely entrained in the molten media and delivered into a molten media circulation path that in turn delivered the charge entrained in the molten media for subsequent heating, further melting and recirculation. The pumping recirculation rate has proved in practice to be exceptional. It has been discovered, however, that because of system parameters, i.e. volume of scrap, heating bay size etc. that this exceptional pump recirculation rate was, in some instances, excessive. As is presently understood in this art useful vortex generation is tied in part to the rotational rate of the impeller. It is not difficult to appreciate that for systems that employ the impeller of the type shown in the '245 and '769 patents that each system has inherently an optimum capacity. What happens when you want to double the rate of charge into the system? In order to maintain the desired vortex, the rate of impeller rotation must be increased substantially, however, the increase in impeller rotation rate causes an already exceptional recirculating pumping rate to become extraordinary. This extraordinary recirculating pumping rate is far greater than necessary to thoroughly melt entrained scrap in the system. The invention to be described more fully hereinafter provides a solution to these just enumerated problems by providing a method and apparatus that effectively result in the partition of the vortex submergence function and the recirculating pumping function.

There have been others that have sought to perfect vortex generation in a scrap aluminum reclamation such as in the van Linden Pat. No. 4,128,415 which has an impeller 70 that employs two sets of blades 71 and 100, which impeller must cooperate with connical wall of the charging bay. While van Linden does appear to recognize that the formation of the vortex 90 is enhanced by the upper blades 100, the impeller structure requires that fluid be drawn upwardly through a central opening in the bottom plate 70 of impeller 100. The subject invention will be seen to distinguish itself over van Linden in both apparatus and method.

Another patent of interest is the Ostberg U.S. Pat. No. 3,554,518 which is directed to improving the reaction between two liquids of different specific gravities. The impeller structure of Ostberg is intended to ensure that there is provided a turbulent flow of the two liquids in a reaction zone. While Ostberg does show in FIG. 3 an embodiment of his invention that includes a dished shaped impeller with vanes 15 disposed on an upper surface of the impeller, which vanes redirect the flow of the slag layer 3, it should be abundently clear that the impeller of Ostberg contains two pumps that cooperate to agitate in a turbulant fashion the fluids involved, rather than as in the invention to be described herein the formation of a vortex for the entrainment of material while simultaneously pumping the fluid into a recirculation path. Another impeller configuration intended to agitate the fluid medium it is in, is that of Foster as shown in U.S. Pat. No. 2,660,525. The Foster impeller while employing a pair of disk shaped plates disposed in a parallel fashion to agitate the medium, requires an independent pump to move the medium through the system.

It is recognized that in the fan impeller art there are centrifugal fans of the type shown by the Watkins Pat. No. 1,447,916 which suggests that the impeller may be so configured such that there is provided an inlet opening at its center of rotation and an outlet to provide an inlet and outlet which redirect the flow vertically backward. The invention to be described hereinafter provides for vortex generation and charge entrainment in a fluid media while simultaneously establishing the pumping of the fluid media into a circulation path. These just enumerated features and advantageous functions are not suggested by Watkins.

SUMMARY OF THE INVENTION

The invention is directed to an improved media circulator and stabilized media vortex generator for submerged use in a system, the prime purpose of which is to submerge and entrain a charge in the media. The charge containing significant quantities of individual pieces that are not readily capable of self-submergence.

The improved vortex generating, charge entraining, media pumping impeller is comprised of a rotatably driven vertical shaft secured to a horizontally disposed lower member which is provided with vane elements that mechanically couple the lower member to a spaced apart horizontally disposed upper member which has a central opening through which a vertical shaft passes and the charge entrained media enters.

The upper and lower members are so shaped as to provide a co-operating configuration such that the charge entrained media is drawn vertically down into the central opening of the upper member and then redirected upwards at an angle from the horizontal and radially accelerated between the vane elements and the upper and lower members to thereby established in the media a circulating force. Simultaneously with the generation of the circulating force there is established a stabilized vortex in the media to thereby provide a media circulator and stabilized media vortex generator that allows for the simultaneous increase in charge entrainment rates in the stabilized vortex in the presence of increased vertical shaft rotation rates and increasing media depths above the upper member.

The invention contemplates, as being within the spirit thereof, a method of creating a stabilized vortex in a media to enhance the entrainment of a charge comprising material not readily entrained while simultaneously establishing a circulation force in the media to cause the entrained charge to be delivered to a media circulation path.

The method comprises two major steps, the first of which is rotating a circulator while the circulator is submerged in the media. The second major step is that of generating simultaneously a downwardly directed fluid current in the media towards a central region of the circulator and an upwardly directed fluid current in the media at an outer periphery of the rotating circulator. This just recited action is the result of the co-operation of the rotating circulator with the media. The downwardly directed fluid current is induced directly by the circulator which has a horizontally disposed lower member which is provided with vanes to mechanically couple the lower member to a spaced apart horizontally disposed upper member which has a central opening that establishes the aforementioned central region through which the downwardly directed fluid current in the media is drawn. The downwardly directed fluid current is then redirected upwardly at an angle from the horizontal and radially accelerated between the vanes and the upper and lower members to thereby establish in the media a circulating force while simultaneously establishing a stabilized vortex in the media.

It is therefore a primary object of the apparatus and method of the invention to provide by means of circulator/impeller configuration alone the generation of a stabilized vortex in a media wherein the vortex generated is stable in its dynamic formation over a wide range of rotational circulator/impeller speeds and increasing distances beneath the surface of the media.

Another object of the invention is to provide an apparatus and method whereby a charge carrying fluid media in a vessel or other containment device is redirected within the vessel or containment device by fluid flow by and through a circulator/impeller such that the fluid is forced to pass through an angle greater than 90 degrees but less than 180 degrees. The redirection being as a result of forces imparted to the fluid by virtue of the inventive geometry of the circulator/impeller and independent of vessel/containment device configuration or nearby wall confinements.

Yet another object of the invention is to provide an improved aluminum scrap entrainment and molten media circulation/impeller that will provide a stabilized vortex in a molten media in which it is submerged and rotated, while simultaneously allowing both increased circulator/impeller rotational speeds and increased depths of molten media above the circulator/impeller.

Still yet another object of the invention is to provide an improved circulator/impeller that will by its unique configuration maintain fluid shear influence over a fluid media in which it is rotatingly submerged while rotational speeds increase thereby preserving a stabilized vortex in the fluid media.

A further object of the invention is to provide an improved circulator that is provided with means to allow a portion of the media to be circulated to be delivered to a region beneath the circulator to thereby flush away foreign objects heavier than the media that may be present beneath the circulator.

In the attainment of the foregoing objects, the apparatus facet of the invention contemplates the provision of a submerged circulator and vortex generator in a fluid media wherein a rotatably driven vertical shaft has secured thereto spaced apart horizontally disposed upper and lower members that are secured to each other by radially extending vanes. The upper member has a central opening through which the vertical shaft passes. The lower member is secured directly to the vertical shaft. The apparatus facet of the invention presently finds expression in at least three embodiments.

In one embodiment the upper and lower members have a co-operating configuration such that the fluid media is drawn vertically down into the central opening of the upper member and then redirected upwards at an angle from the horizontal and radially accelerated between the vanes that join the upper and lower members. In this embodiment the upper and lower members are equidistantly spaced apart and of convex dish shape with the upper dish shaped member having an outer diameter less than the lower member to thereby cooperate in the redirection of the media at the upward angle.

In another embodiment of the invention the upper and lower members are horizontally disposed, spaced apart and of a bowl shape wherein each member is characterized by horizontally disposed bottom portions which are integrally connected to generally vertical side portions to thereby co-operate in the redirection of the fluid media at an upward angle. In this embodiment, as well, the diameter of the upper bowl shaped member is smaller than the lower member.

The bowl shaped upper and lower members are disposed in a nested relationship with their respective bottoms and sides portion equidistant from each other. As in the first embodiment identified above, radially extending spaced apart vanes mechanically enterconnect the upper and lower bowl shaped members. The upper bowl shaped member is provided with a central opening and the lower bowl shaped member is secured to a vertical shaft. The generally vertical side portions of the lower bowl shaped member is provided with openings between adjacent vanes to thereby cause a portion of the redirected media to exit the openings while simultaneously providing for the redirection of another portion of the fluid media in and upward direction.

The method described hereinbefore makes use of both of the circulator/impeller embodiments as the practice of the method is carried out.

In yet another embodiment of the invention the improved circulator the rotatably driven vertical shaft is secured to a horizontally disposed lower member which is provided with mechanical vanes to couple the lower member to a spaced apart horizontally disposed upper member which upper member has a central opening through which the vertical shaft passes and the media is drawn as a result of the vertical shaft being driven.

The upper and lower members have a cooperating configuration such that upon rotation of the vertical shaft the media is drawn vertically down into the central opening of the upper member, whereupon the media is divided into a first and second portion.

The lower member is provided with centrally disposed openings to thereby allow the first portion of the media to pass through the openings in the lower member and flush from a region beneath the circulator any objects heavier than the media that may be present beneath the circulator.

The second portion of the media is radially accelerated between the vanes and the upper and lower members to thereby establish in the media a circulating force.

Other objects and advantages of the present invention will become apparent from the ensuing description and illustrate embodiments thereof, in the course of which, reference is made to the accompanying drawings.

DETAILED DESCRIPTIONS OF THE PREFERRED EMBODIMENTS

Figure 1:
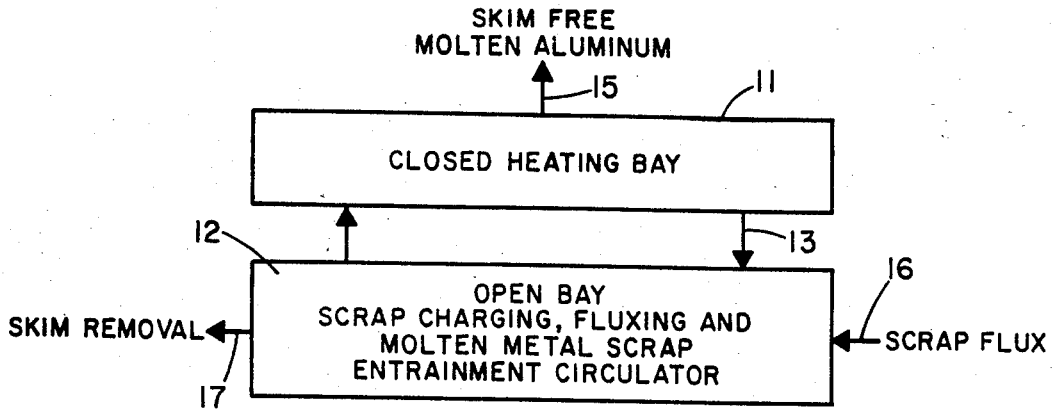
FIG. 1 PRIOR ART
FIG. 1 is a block diagram of a prior art recirculating scrap melting system that embodies the invention.
Figure 2:
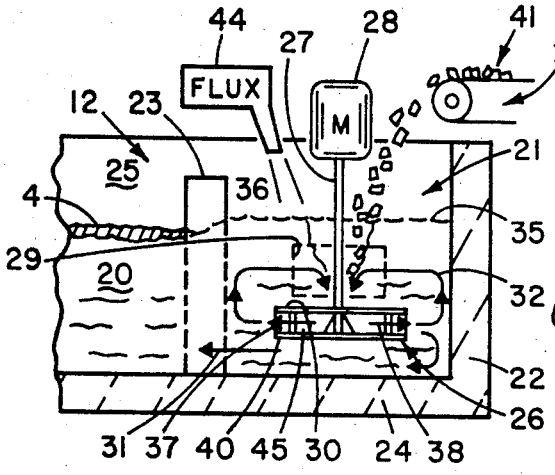
FIG. 2 PRIOR ART
FIG. 2 is a partial vertical section of an open charging and pumping bay, of the type employed in the prior art system of FIG. 1, with a molten media level as shown.
Figure 3:
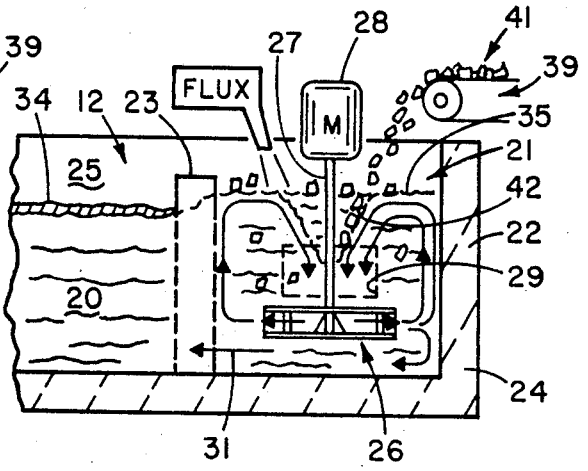
FIG. 3 PRIOR ART
FIG. 3 is a partial vertical section of the same open charging and pumping bay of FIG. 2 wherein the molten media level is as shown.

Reference is now made to FIG. 1 which depicts in block diagram form a recirculating scrap melting system that will embody the invention. The system illustrated is that which is shown in U.S. Pat. No. 4,322,245 ('245) issued to the same inventor as this application. The apparatus of the system includes a closed heating bay 11 and an open bay 12. In the open bay 12 scrap and flux are introduced. A scrap entrainment molten metal circulator of the type shown in FIGS. 2 and 3 is positioned in the open bay in a manner to be described more fully hereinafter. The circulator causes molten metal to circulate from the closed heating bay 11 into the open bay 12 as indicated by flow arrow 13. The molten metal is then circulated into the closed heating bay 11, as indicated by arrow 14. Scrap and flux are introduced at one end of the open bay 12 as indicated by flow arrow 16 and skim or dross is removed from the opposite end of the open bay 12 as indicated by flow arrow 17. The final product of the systems apparatus is skim free molten aluminum delivered from the closed heating bay 11 as indicated by flow arrow 15.

Figures 6, 6A:
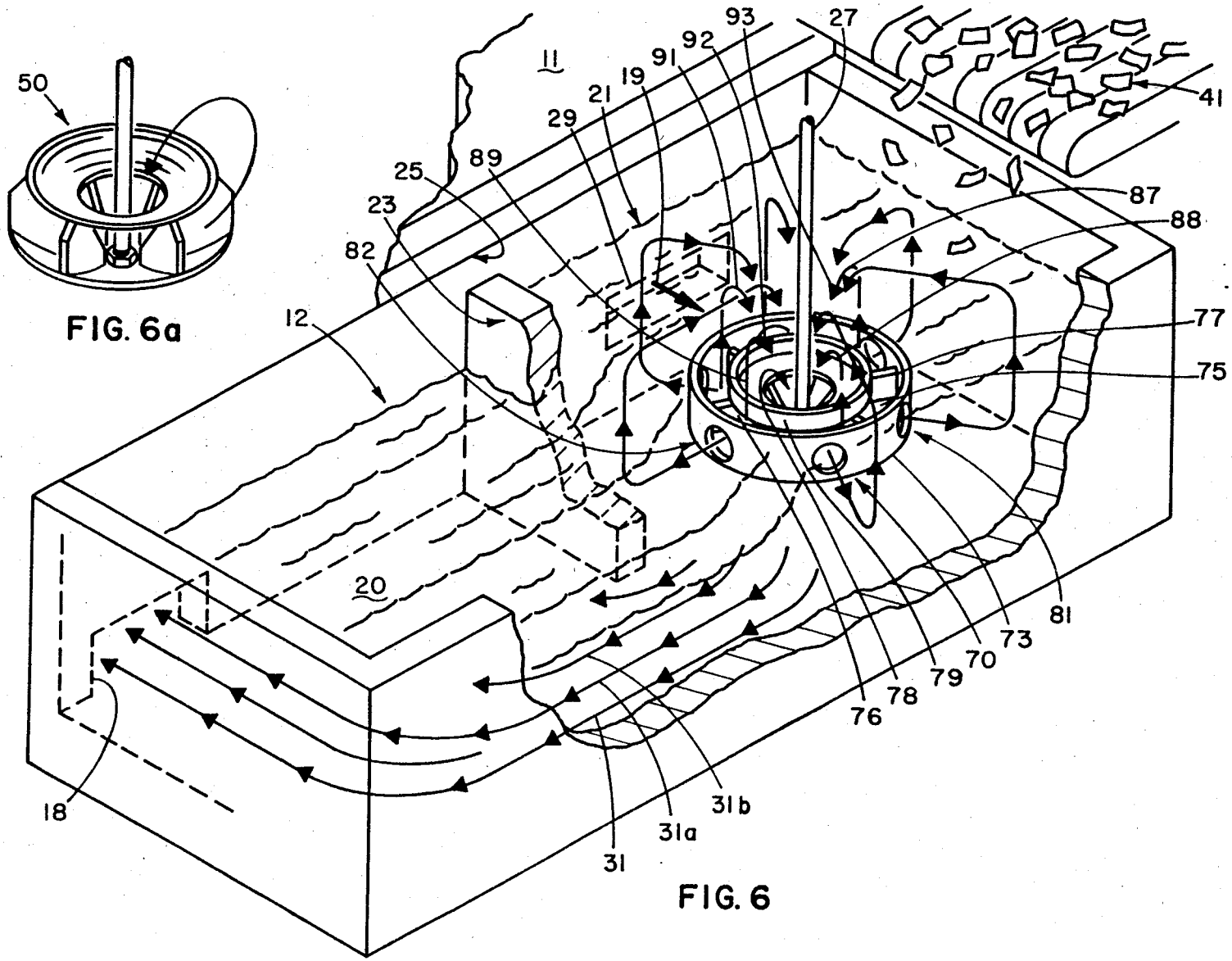
FIG. 6 is a three dimensional showing of an open charging and pumping bay with the embodiment of FIG. 5 of the circulator/impeller of the invention illustrated with molten media fluid current paths shown by arrows.
FIG. 6*a* is a three dimensional showing the embodiment of a circulator/impeller of the FIG. 5 embodiment of the invention.

Reference to now made to FIG. 2 which shows a partial vertical section of the prior art molten metal circulator 26 of the type shown in the '245 patent. It should be understood that in respect of the remaining figures where common components are shown the same reference numerals will be employed to designate the same components. The open bay indicated by arrow 12 is provided, and as shown in the right hand portion of FIG. 2 a pumping bay 21 has shown a circulator 26 rotatably secured to a motor 28. The open bay 12 is defined by a side wall 22, a bottom wall 24 and a rear wall 25, all of which are fabricated from a suitable refractory material. The open bay 12 has a front wall as shown in FIG. 6. The pumping bay 21 is formed in part by a wall segment 23 which is integral with the back wall 25 and juts out into the open bay 12 as best seen in FIG. 6. Accordingly, as indicated in FIG. 2, the pumping bay 21 is comprised of the wall segment 23, a portion of the back wall 25, all of side wall 22 and a portion of the open bay end wall not shown in FIG. 2. That portion of the back wall 25 defined as forming the pumping bay 21 is provided with a back wall opening 29 through which opening molten metal media flows from a closed heating bay 11 as discussed in respect of FIG. 1. A conveyor 39 carries scrap 41 that has by its nature a high surface area to volume ratio and therefore tends not to be self-submersible. Shredded aluminum cans or entire cans, as well as small chips collected from manufacturing operations are typical of the non-self sumersible scrap. Flux supply 44 is shown delivering a fluxing agent into a vortex 36 as shown. Spent flux and skim 34 is shown on the surface of molten media 20 to the left of the wall segment 23. It should be noted that a clean molten metal surface 35 is formed in the pumping bay 21. The open bay 12 is filled with a molten metal media 20 to an optinum level as shown in FIG. 2. This optimum level can and does change. The optimum level is selected such that the rotation of the circulator 26 at a selected rate by the motor 28 induces the generation of an appropriate vortex 36 in the molten metal media 20.

The circulator 26 as defined in the '245 patent draws the molten metal media including the non-self-submersible scrap or charge into the top of the circulator as shown by molten metal vortex current path arrows 32, 33 whereupon the molten media and charge is turned from a vertically downward direction and accelerated in a horizontally outward direction as shown by arrows 37, 38 and discharged tangentially through spaces defined by a top plate 30, bottom plate 40 and radial vanes 45. The fluid discharges tangentially around the entire circumference of the circulator 26 and thereby in part establishes a circulation current path 31. As noted hereinbefore an opening 29 allows molten media to flow into the pumping bay. At all other locations in the pumping/charging well around the circumference of the impeller the fluid flowing horizontally from the impeller strikes the confines of pumping/charging well walls. A portion of this fluid striking the charging well walls turns vertically upward, e.g. arrows 32, 33, passes to the surface 35 of the molten media in the pumping/charging well 21. In this manner, a portion of the molten media entering the pumping/charging well 21 from the heating bay 11 via opening 29 is recirculated in the continuous vortex 36.

Attention is now directed to FIG. 3 where in the molten media 20 and its level in the open bay 12 is as shown. It should be recognized that as the molten media depth above the circulator 26 increases as shown in FIG. 3 vs. FIG. 2, the rotational speed of the circulator-/impeller 26 must be increased in order to maintain fluid shear influence and thereby preserve the vortex 42 at the surface 35 of the pumping/charging well 21. This increase rotational speed of the circulator 26 results in an increase recirculation pumping rate into molten metal circulation path 31 which rate is well in excess of that necessary to convectively transfer heat from the heating bay 11 to the scrap 41 being introduced into the charging/pumping well 21.

Figure 4:
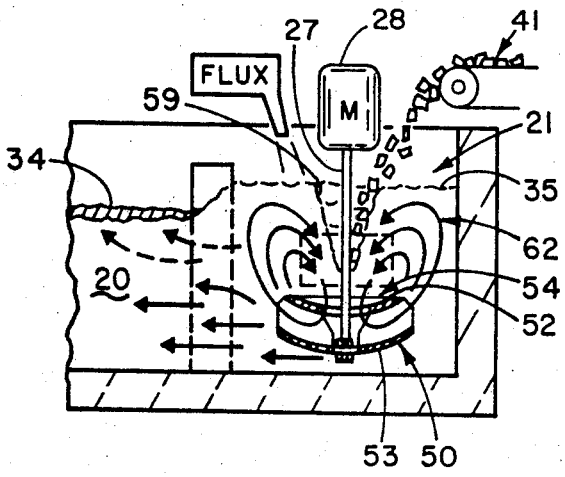
FIG. 4 is a partial vertical section of an open charging and pumping bay with one embodiment of the invention depicted.
Figure 5:
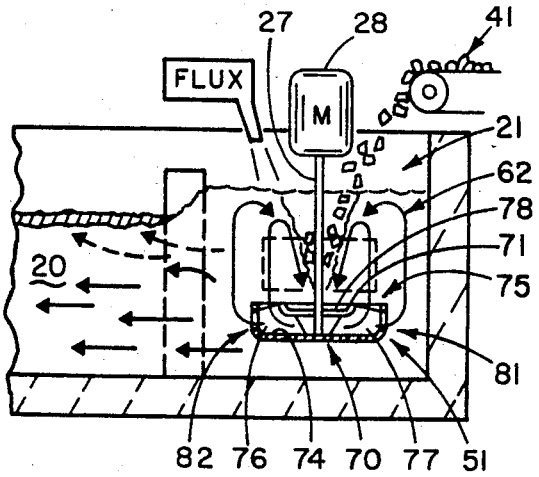
FIG. 5 is a partial vertical section of an open charging and pumping bay with another embodiment of the invention illustrated.

Reference is now made to FIGS. 4 and 5 where a separate embodiment of the invention is shown in each figure. In each of these figures the circulator/impeller 50, 51 by impeller configuration alone produces a vortex in the charging/pumping well 21 which is more stable with respect to impeller rotation rate at increasing distances beneath the molten metal surface 35.

The details of circulator/impeller 50 will be described in more detail hereinafter. From the cross-sectional showing of impeller 50 in FIG. 4 it will be observed the impeller has a concave dish shaped upper and lower member 52, 53. The upper member 52 has a central opening 54. The upper and lower members 52, 53 are interconnected by spaced apart vanes 60, 61. The concavity of the top member assists the smooth entrance of molten metal on the suction side of the impeller 50 through the central opening 54 in the upper member 52. The matched concavities of the upper and lower members 52, 53 and cause the molten metal to be drawn vertically downward, redirected, and radially accelerated in such a manner as to turn it upward from the horizontal at a measurable angle. The vertical or upward redirection of the molten metal through an angle greater than 90 degrees provides an intentional recirculation of a greater portion of the molten metal through the vortex 59 while pumping percentagewise less fluid from the charging/pumping well 21 to that region of the open bay 2 where skim and spent flux 34 are to be removed.

Figure 8:
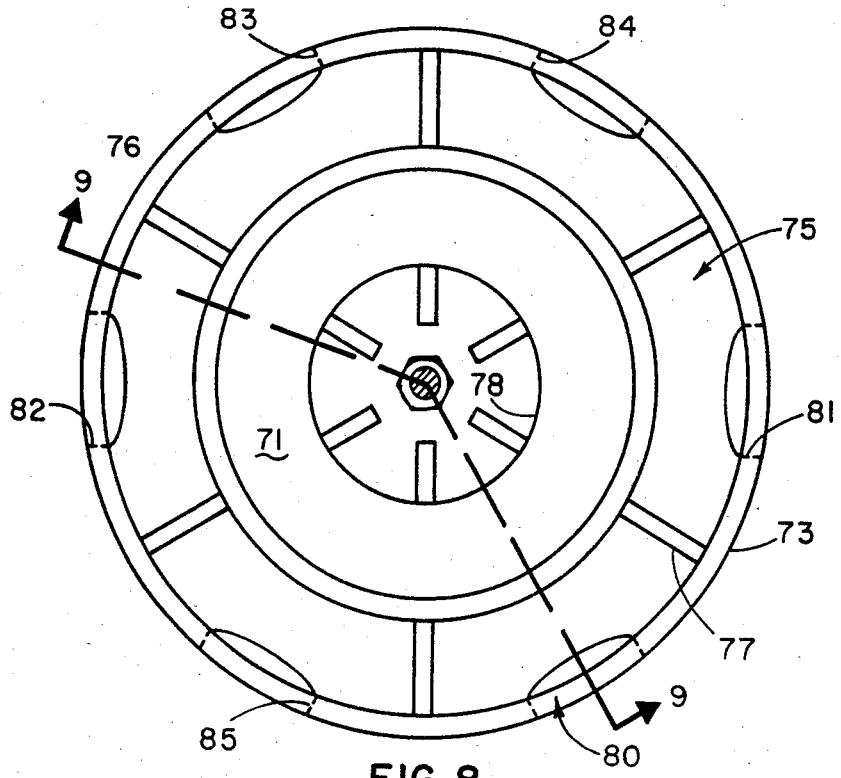
FIG. 8 is a top view of another circulator/impeller that embodies the invention.
Figure 9:
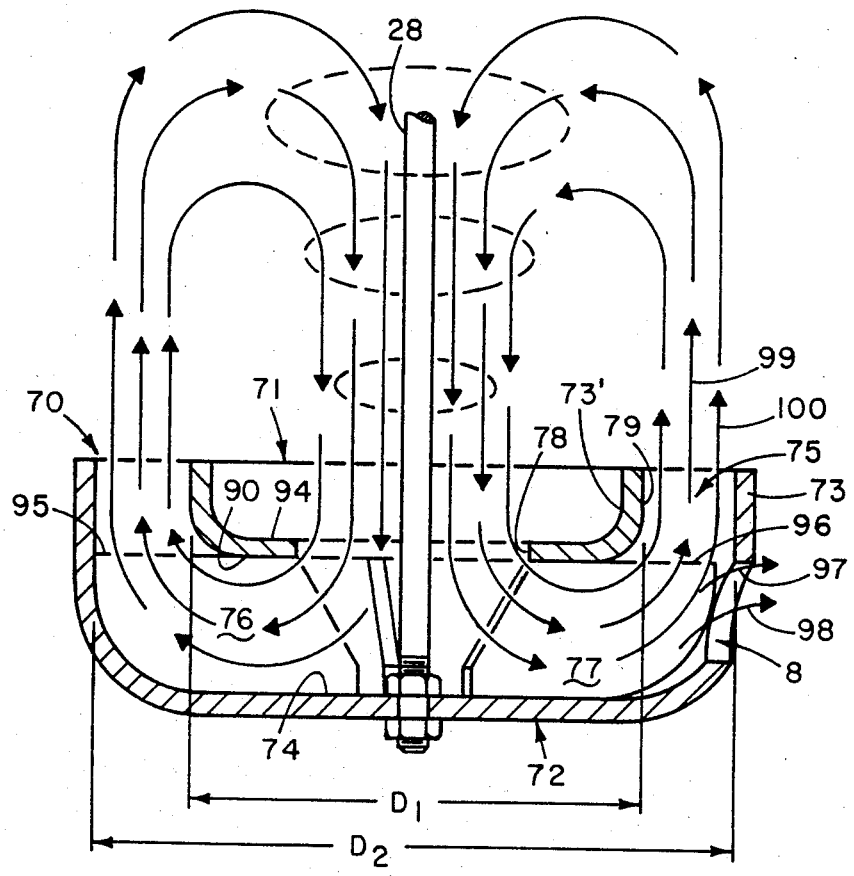
FIG. 9 is a section taken along 9—9 in FIG. 8

Reference is now made specifically to FIG. 5 which shows the cross-sectional detail of another preferred embodiment of the invention. It can easily be envisioned that a continuing increase in the degree of concavity of the upper and lower members 52, 53, FIG. 4, would result in more increasingly greater percentage of fluid remaining within the vortex patern 62 and an increasingly lesser percentage of the fluid being pumped from the charging/pumping well 21 and around the furnace circuit depicted in FIG. 1. The second preferred embodiment, shown in cross-sectional detail in FIG. 5, represents a more drastic redirection of the molten metal discharged from the circulator/impeller 70. The second, more drastic modification of the circulator/impeller 70, the construction details of which will be explained in more detail hereinafter, in respect of FIGS. 6, 8, and 9 provides a concave or bowlshaped upper member 71 which is intentionally smaller in outside diameter than the bottom concave bowl shaped member 72. A portion 74 of the bottom member 72 is shown flat, although it could be concave.

The important feature of this second embodiment bottom member 72 resides in the fact that it extends not only to the periphery of the circulator/impeller 70 but then vertically upward (see FIGS. 6, 8 and 9) to form a vertical side wall 73 that completely encases the top member 71 allowing an anular space 75 between the outside periphery 79 of the bottom member vertical side wall 73 and the concave upper member 71. Vertical radial vanes 76, 77 secured to the upper and lower members 71, 72 are employed to accelerate the molten media between the upper member 71 and lower member 74 during operation. At locations, best seen in FIGS. 6, 8 and 9, which locations are intermediate between points of attachment of the radial vanes 76, 77 to the nearly vertical side wall 73 are ports 81, 82 which allow a portion of the molten metal radially accelerated between the upper and lower members 71, 72 to be discharged in a tangential manner to thereby assist in the generation of the molten metal circulation current path 31. Only a portion of the molten metal is allowed to pass through the ports in the vertical side wall 73. The majority of the molten metal is forced to pass through a path representing a 180 degree turn, thus a substantial amount of fluid entering the central opening 78 in upper member 71 is forced completely back on itself and discharged from the impeller in a vertically upward direction as is indicated by vortex flow arrows 87, 88, 89 and 90.

It has been observed in tests that the preferred embodiments just described in respect of FIGS. 4 and 5 resulted in a significantly more stable vortex, particularly when the side walls of the pumping/charging well were located at some distance from the impeller.

Reference is now made to FIG. 6 in which there is illustrated a three dimensional showing of an open bay 12 and pumping/charging bay 21 in which environment the method of the invention comes into existence. As noted earlier the impeller 70, configured as shown and describe in respect of FIG. 5, is located in the pumping/charging well 21. The impeller 70 is driven by a motor 28 (see FIG. 5) not shown in FIG. 6 via a shaft 27 secured to the impeller 70 in a manner to be described hereinafter. Positioned behind the open bay 12 and shown partially in FIG. 6 is the closed heating bay 11 described in respect of FIG. 1. The closed heating bay 11 communicates with the open bay 12 via opening 29. The closed heating bay 11 recieves molten media 20 via opening 18.

The next step entails the simultaneous generation of a downwardly directed fluid current, see for example arrow heads 92, 93, in the media 20 towards a central region, here defined by the rotating shaft 27 and central opening 78 of the impeller 70, and an upwardly directed fluid current in the media 20 evidenced by vortex flow arrows 87, 88, 89, at an outer periphery (i.e. annular space 75 of the impeller/circulator 70). The downwardly directed fluid current is induced directly by the impeller/circulator 70 which has a horizontally disposed concave bowl shaped lower member 72 which is provided with mechanical vanes (e.g., 76, 77) to couple the lower member to a spaced apart horizontally disposed concave bowl shaped upper member which has the central opening 78 of the central region through which opening the downwardly directed fluid current is drawn. The downwardly directed fluid current is redirected upwardly at an angle from the horizontal and radially accelerated between the vanes and the upper and lower members to thereby establish in the media 20 a circulating force while simultaneously establishing a stabilized vortex in the media.

FIG. 6*a* illustrates in three dimensional form another preferred embodiment of the invention. This form of the invention can be inserted in the well 21 in place of impeller 70.

Returning to FIG. 6 it will be observed that there is an opening 29 positioned slightly above the impeller 70 which opening allows heated molten metal to be discharged into the pumping/charging bay 21 as is indicated by flow arrow 19.

The method contemplates the creation of a stabilized vortex in a media, such as molten metal media 20, to enhance the entrainment of a charge comprising pieces not readily submergable, here shown as a scrap aluminum 41. It should be appreciated that the charge might also be of another material than the media and may in fact be in liquid form. It goes with out saying that the method of this invention when employed to generate a vortex into which a liquid is being introduced would be most effective when the liquid charge is of the type that tends to stay on the surface of the media. Simultaneously with the creation of the stabilized vortex there is established a circulation force evidenced by circulation current paths 31, 31*a*, 31*b* in the media 20 to thereby cause the entrained charge 41 to be delivered to the circulation current paths.

The method entails, first, rotating the impeller/circulator 70 by motor 28 via shaft 27 while the impeller/-circulator is submerged as shown embodiment of the invention as earlier described in respect of FIG. 5. The impeller/circulator 50 of FIG. 6*a* may interchangeably be employed in the environment of FIG. 6 depending upon the desired pumping/recirculation rate and vortex required for the given application of the method.

Figure 7:
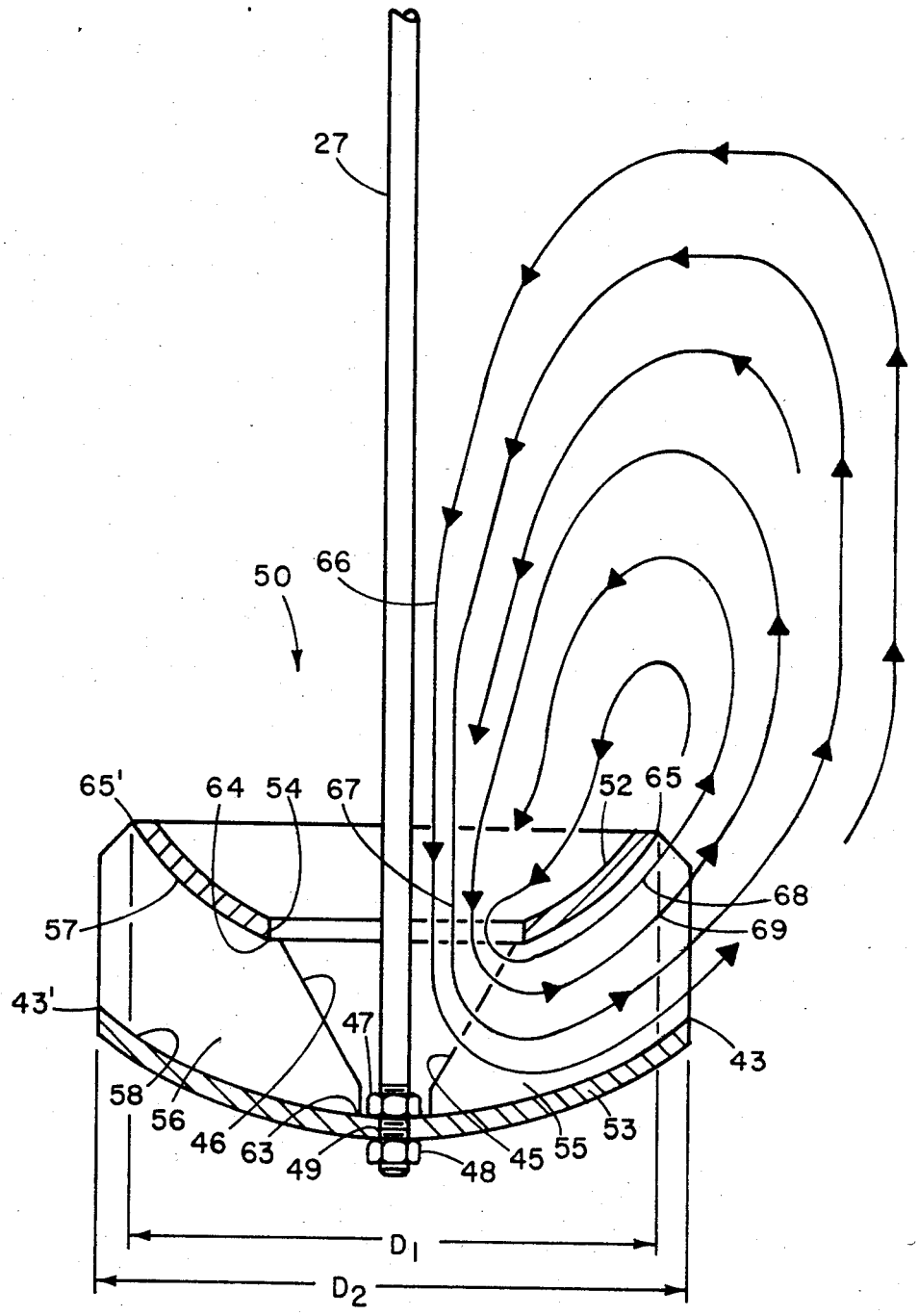
FIG. 7 is a cross-section of a circulator/impeller that embodies the invention.

Reference is now made to FIG. 7 in which there is shown the FIG. 5 embodiment of the apparatus invention in cross-section. A shaft 27 is shown connected the impeller/circulator 50 by a pair of nuts 47, 48 carried by threaded portion 49 of the shaft 27. The thread portion 49 of the shaft 50 passes through an unreference opening in the lower member 53. The manner by which the shaft 27 is secured to the lower concave shaped member 53 is not part of the invention. The concave shaped upper and lower members 52 and 53 have an overall circular dish shaped appearance. The upper concave dish shaped member 52 has an outer diameter "$D_1$" that is less than the outer diameter "$D_2$" of the lower concave dish shaped member 53. In order to facilitate the redirection of the media from vertically downward to an upward angle the upper concave dish shaped member 52 has a lower surface 57 that is equidistant from an upper surface 58 of the lower concave dish shaped member 53. The upper member 52 is provide with a central opening 54 through which the molten media is drawn as evidenced, for example by flow arrows 66, 67. The upper and lower concave dish shaped members are position in what is termed a spaced apart, nested relationship.

Vanes 55, 56 are integrally coupled to the upper and lower members 52, 53 and cooperate with the concave configurations of the upper and lower members 52, 33 to radially accelerate the media as indicated, for example, by flow arrows 68, 69. Each of the vanes of the impeller 50 have as shown here in FIG. 7 in respect of vanes 55, 56 an inner portion 45, 46 respectively that extends between the lower member 53 and the upper member 52 from points 63, 63' to point 64, 64' adjacent the central opening 54 in the upper member. As noted before each vane is secured respectively to the lower and upper members 52, 53 and each has an outer end co-terminus at points 65, 65' with an outer periphery 43, 43' of each of the upper and lower members 52, 53.

Reference is now made to FIGS. 8 and 9, which are to be taken together in respect of the description that follows next. In the invention embodiment of FIGS. 8 and 9 the impeller/circulator 70 has upper and lower members 71, 72 which are of a bowl shape with each of the upper and lower members 71, 72 being characterized respectively by horizontally disposed bottom portions 94, 74 which are integrally connected to generally vertical side wall portions 73', 73 that cooperate in the redirection of the media at an upward angle. Not unlike the embodiment of FIG. 4 and 7 the upper bowl shaped member 71 has an outer diameter "$D_1$" that is less than the outer diameter "$D_2$" of the lower bowl shaped member 72. The horizontally disposed bottom portions 74, 94 are equidistant from each other as are the vertical side wall portions 73', 73.

In this embodiment the height of the generally vertical side wall portion 73 of the lower bowl shaped member 72 is equal to the sum of the distance between the horizontally disposed bottom portions 74, 94 of the lower and upper member 72, 71 and the height of the generally vertical side portion 73' of the upper member 71.

As can be seen in FIG. 8, and 9 a plurality of mechanical radially positioned vanes are located as shown, two of which are reference, namely vanes 76, 77. In a manner similar to the invention embodiment of FIG. 4 and 7 it will be noted that vanes 76, 77 each has an inner portion extending between the lower and upper bowl shaped members 72, 71 from a point adjacent the shaft 27 where the shaft is secured to the lower member 72 to a point adjacent the central opening 78 in the upper member. Each of the vanes are secured respectively to the lower and upper members 72, 71 and each has an outer end, for example outer ends 95, 96 of vanes 76, 77, that extends to a line co-terminus with a plane containing a lower surface 90 of the horizontally disposed bottom portion 94 of the upper bowl shaped member 71.

The generally vertical side portion 73 of the lower bowl shaped member 72 is provided with a plurality of openings or ports 80, 81, 82, 83, 84 and 85 (FIG. 8) to thereby cause a portion of the redirected media to exit the openings (see flow arrows 97, 98) while simultaneously providing for the redirection of another portion of the media in an upward direction (see flow arrows 99, 100). Each of the openings or ports 80, 81, 82, 83, 84, 85 are located between the radial vanes and the openings extend no higher on the vertical side wall portion 73 than a line defined by the plane that includes the lower surface 90 of the horizontally disposed bottom portion of the upper bowl shaped member 71.

Figure 10:
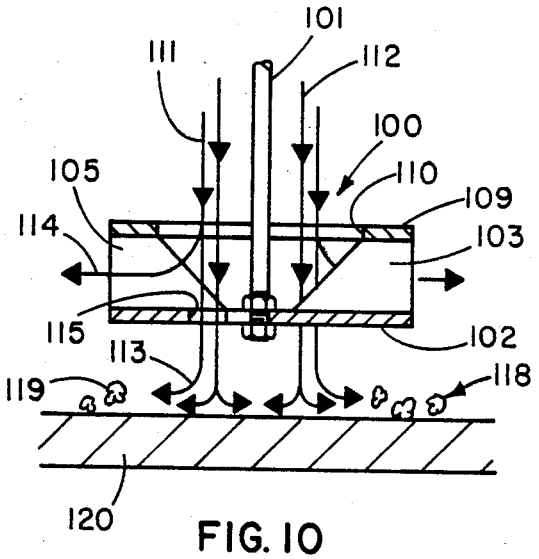
FIG. 10 is a cross-sectional illustration of one embodiment of the invention in which an improved media circulator is provided with means to flush foreign objects having a density greater than the media from beneath the circulator.
Figure 11:
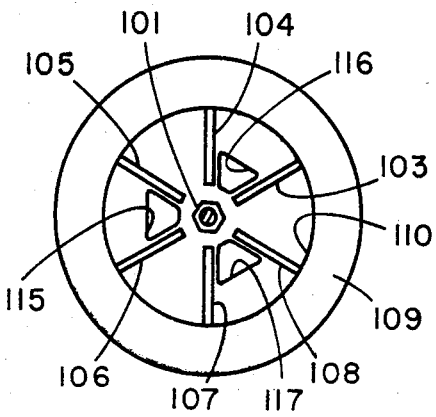
FIG. 11 is a top view of FIG. 10.

Reference is now made to FIGS. 10 and 11 in which another embodiment of the invention is shown provide with means to flush away objects having a density greater than the media from beneath the circulator/impeller and the charging well floor.

In the embodiments of the invention heretofore shown and described it is recognized that sinking foreign objects tend to collect under the circulator/impeller and on the floor of the charging well. This area or region beneath the center of the bottom of the circulator is a low pressure, relatively stagnant region. Rocks, bits of refractory lining and other objects which are slightly heavier than molten aluminum tend to collect in this region and interfere with the circulator/impeller. The embodiment of the invention now to be described provides means in the form of openings or holes in a lower member of the circulator/impeller to thereby allow some of the fluid (ie media), ingested by the circulator/impeller to pass through the lower member in order to flush away the foreign objects from the region.

Accordingly it will be observed in the cross-sectional showing of FIG. 10 and the top view FIG. 11 that there is shown a circulator/impeller 100 which is provided with a rotatably driven vertical shaft 101 secured, by the nut arrangement not referenced, to a horizontally disposed lower member 102. The lower member 102 is provided with vanes 103, 104, 105, 106, 107 and 108 that are integrally secured as shown to the lower member 102 and an upper member 109. The lower member 102 has a central opening 110 through which the vertical shaft 101 passes. In FIG. 10 there are shown a number of media flow arrows 111, 112 which are intended to convey the idea that the media (not referenced) that surrounds the circulator/impeller 100 is drawn in a vertically downward direction and through the central opening 110 of the upper member 109. The upper and lower members 102, 109 have a cooperating configuration, as discussed earlier, such that upon rotation of the vertical shaft 101 the media is drawn vertically down as evidenced by media flow arrows 111, 112 into the central opening, whereupon the media is divided into a first portion shown by flow arrow 113 and a second portion, as shown by flow arrow 114. The lower member 102 is provided with centrally disposed openings 115, 116, 117 through which the first portion 113 of the media passes.

From the preceding description and a study of the FIGS. 10 and 11 it should be apparent that the first portion of the media passes through the openings in the lower member and flush from the region beneath the circulator the sinking objects 118, 119 that may be present.

The second portion of the media, evidenced for example by flow arrow 114, is radially accelerated between the vanes 105, 106 and the lower and upper members 102, 109 to thereby establish in the media a circulation force.

It is recognized that since the media passing through the openings in the lower member represent a reduction in pumping efficiency, the openings should be sized such that a reasonable level of flushing occurs beneath the lower member without a significant reduction in pumping capacity. For example where a twenty-four inch diameter impeller of the configuration shown in FIGS. 10 and 11 is involved, three openings 115, 116 and 117, approximately two inches by two inches or two inches by three inches, would be adequate. For an eight vane impeller, not shown, there would be four openings of approximately the same size.

Figure 12:
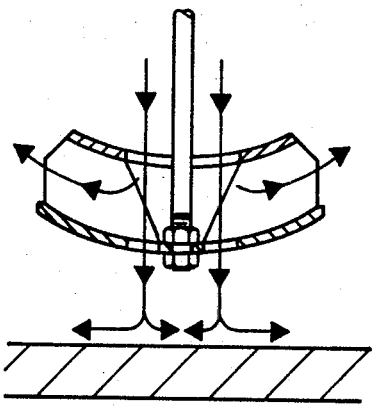
FIG. 12 is a cross-sectional view of another embodiment of the invention in which an improved media circulator is provided with means to flush heavier foreign objects from beneath the circulator.
Figure 13:
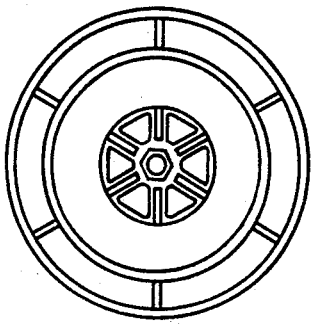
FIG. 13 is a top view of FIG. 12.
Figure 14:
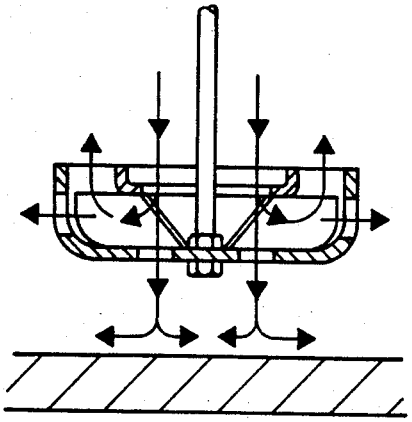
FIG. 14 is a cross-sectional view of yet another embodiment of the invention in which an improved media circulator is provided with means to flush heavier foreign objects from beneath the circulator.
Figure 15:
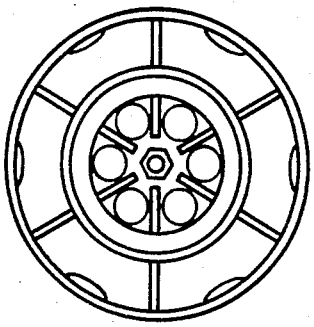
FIG. 15 is a top view of FIG. 14.

A detail description of FIGS. 12 and 13 as well as FIGS. 14 and 15 will not be provided as the operation of the various circulator/impeller configurations shown have already been described.

It is, however, worthy of note that in FIGS. 12 and 13 as contrasted to FIGS. 11, 12 the number of openings in FIGS. 12, 13 is twice the number as that shown in FIGS. 11, 12. In FIGS. 14, 15 the openings (not referenced) are shown to have a round configuration.

While the invention has been described wherein the media is molten aluminum metal and the charge is of aluminous scrap the invention contemplates as being within its perview other types of media and other kinds of charge. The charge may be liquid or a semisolid. The media may be comprised of multiphase liquids, solid particles in a liquid or immiscible liquid particles in a liquid.

In view of the above description it should be abundently clear the system and apparatus as well as the method of the systems operation provides a distinct improvement of the state of art.

Although only three embodiments of the invention have been illustrated and described, it will apparent to those skilled in the art that various changes and modifications may be made to these embodiments without departing from the spirit and scope of the invention.

What I claim as new:

1. An improved media circulator and stabilized media vortex generator for submerged use in a system for submerging and entraining a charge in a media wherein said change comprises pieces not readily capable of self-submergence, said circulator and stabilized media vortex generator comprising:

a rotatably driven vertical shaft secured to a horizontally disposed lower member which is provided with mechanical vane means to couple said lower member to a spaced apart horizontally disposed upper member which has a central opening through which said vertical shaft passes and said media enters, said upper and lower members having curved portions that are positioned in a nested mating relationship such that said media is drawn vertically down into said central opening of said upper member and then redirected upwards at an angle from the horizontal because of said curved portions and radially accelerated between said vane means and said upper and lower members to thereby establish in said media circulating force while simultaneously establishing a stabilized vortex in said media to thereby provide a media circulator and stabilized media vortex generator that allows simultaneously increasing charge entrainment rates in said stabilized vortex in the presence of increased vertical shaft rotation rates and increasing media depth above said upper member.

2. The improved media circulator and stabilized media vortex generator of claim 1 wherein said mechanical vane means are spaced apart and radially disposed between, said upper and said lower members.

3. The improved media circulator and stabilized media vortex generator of claim 2 wherein said upper and said lower members are of a concave dish shape to thereby cooperate in the redirection of said media at said upward angle.

4. The improved media circulator and stabilized media vortex generator of claim 3 wherein said upper concave dish shaped member has an outer diameter less than an outer diameter of said lower concave dish shaped member.

5. The improved media circulator and stabilized media vortex generator of claim 4 wherein said upper concave dish shaped member has a lower surface that is equidistant from an upper surface of said lower concave dish shaped member.

6. The improved media circulator and stabilized media vortex generator of claim 4 wherein said upper and said lower concave dish shaped members are positioned in a spaced apart nested relationship.

7. The improved media circulator and stabilized media vortex generator of claim 6 wherein each of said mechanical vane means has an inner portion extending between said lower and said upper members from a point adjacent said shaft when said shaft is secured to said lower member to a point adjacent said central opening in said upper member, each of said vane means being secured respectively to said lower and upper members and each having an outer end co-terminus with an outer periphery of each of said lower and said upper concave dish shaped members.

8. The improved media circulator and stabilized media vortex generator of claim 7 wherein said upper and said lower members are of a bowl shape, each member characterized by horizontally disposed bottom portions which are integrally connected to generally vertical side portions to thereby cooperate in the redirection of said media at said upward angle.

9. The improved media circulator and stabilized media vortex generator of claim 8 wherein said upper bowl shaped member has outer diameter less than an outer diameter of said lower bowl shaped member.

10. The improved media circulator and stabilized media vortex generator of claim 9 wherein said horizontally disposed bottom portions of said upper and said lower bowl shaped members are equidistant from each other.

11. The improved media circulator and stabilized media vortex generator of claim 10 wherein said generally vertical side portions of said upper and said lower bowl shaped members are equidistant from each other.

12. The improved media circulator and stabilized media vortex generator of claim 11 wherein the height of said generally vertical side portion of said lower bowl shaped member is equal to the sum of the distance between horizontally disposed bottom portions of said lower and said upper members and the height of said generally vertical side portion of said bowl shaped upper member.

13. The improved media circulator and stabilized media vortex generator of claim 12 wherein each of said mechanical vane means has an inner portion extending between said lower and said upper bowl shaped members from a point adjacent said shaft where said shaft is secured to said lower member to a point adjacent said central opening in said upper member, each of said vane means being secured respectively to said lower and upper members and each having an outer end that extends to a line co-terminus with a plane containing a lower surface of said horizontally disposed bottom portion of said upper bowl shaped member.

14. The improved media circulator and stabilized media vortex generator of claim 13 wherein said generally vertical side portion of said lower bowl shaped member is provided with openings to thereby cause a portion of said redirected media to exit said openings while simultaneously providing for the redirection of another portion of said media in an upward direction.

15. The improved media circulator and stabilized media vortex generator of claim 14 wherein said openings in said vertical side portions are located between said said vane means.

16. The improved media circulator and stabilized media vortex generator of claim 15 wherein said openings extend no higher on said vertical side portions than a line defined by said plane that includes said horizontally disposed bottom portion of said upper bowl.

17. The improved media circulator and stabilized media vortex generator of claim 16 wherein the said media is molten metal.

18. The improved media circulator and stabilized media vortex generator of claim 17 wherein said molten metal is aluminum.

19. The improved media circulator and stabilized media vortex generator of claim 18 wherein said change is aluminous scrap.

20. The improved media circulator and stabilized media vortex generator of claim 7 wherein said media is molten metal.

21. The improved media circulator and stablilzed media vortex generator of claim 20 wherein said molten metal is aluminum.

22. The improved media circulator and stabilized media vortex generator of claim 21 wherein said charge is aluminous scrap.

23. A method of creating a stabilized vortex in a media to enhance the entrainment of a charge comprising pieces not readily submergable while simultaneously establishing a circulation force in said media to cause entrained charge to be delivered to a media circulation path, the method comprising the steps of (a) rotating a circulator means while said circulator means is submerged in said media, (b) generating simultaneously a downwardly directed fluid current in said media towards a central region of said circulator means and an upwardly directed fluid current in said media at an outer periphery of said circulator means by the co-operation of said circulator means with said media, said downwardly directed fluid current being induced directly by said circulator means which has a horizontally disposed lower member which is provided with mechanical vane means to couple said lower member to a spaced apart horizontally disposed upper member which has a central opening establishing said central region through which said downwardly directed fluid current is drawn, said downwardly directed fluid current being redirected upwardly at an angle from the horizontal and radially accelerated between said vane means and said upper and lower members to thereby establish in said media a circulating force while simultaneously establishing a stabilized vortex in said media.

24. The method of claim 23 wherein said upper and said lower members of said circulator means are of a convex dish shape to thereby co-operate in the redirection of said media at said upward angle.

25. The method of claim 24 wherein said upper convex dish shaped member has an outer diameter less than an outer diameter of said lower convex dish shaped member.

26. The method of claim 25 wherein said upper convex dish shaped member has a lower surface that is equidistant from an upper surface of said lower convex dish shaped member.

27. The method of claim 26 wherein said media is molten metal.

28. The method of claim 27 wherein said molten metal is aluminum.

29. The method of claim 28 wherein said charge is aluminous scrap.

30. The method of claim 23 wherein said upper and lower members are of a bowl shape, each member characterized by horizontally disposed bottom portions which are integrally connected to generally vertical side portions to thereby co-operate in the redirection of said media at said upward angle.

31. The method of claim 30 wherein said upper bowl shaped member has an outer diameter less than an outer diameter of said lower bowl shaped member.

32. The method of claim 31 wherein said horizontally disposed bottom portions of said upper and said lower bowl shaped members are equidistant from each other.

33. The method of claim 32 wherein the height of said generally vertical side portion of said lower bowl shaped member is equal to the sum of the distance between said horizontally disposed bottom portions of said lower and said upper members and the height of said generally vertical side portion of said bowl shaped upper member.

34. The method of claim 33 each of said mechanical vane means has an inner portion extending between said lower and said upper bowl shaped members from a point adjacent said shaft where said shaft is secured to said lower member to a point adjacent said central opening in said upper member, each of said vane means being secured respectively to said lower and upper members and each having an outer end that extends to a line co-terminus with a plane containing said horizontally disposed bottom portion of said upper bowl shaped member.

35. The method of claim 34 wherein said generally vertical side portion of said lower bowl shaped member is provided with openings to thereby cause a portion of said redirected media to exit said openings while simultaneously providing for the redirection of another portion of said media in an upward direction.

36. The method of claim 35 wherein said openings in said vertical side portions are located between said said vane means.

37. The method of claim 34 wherein said openings extend no higher on said vertical side portions than a line defined by said plane that includes said horizontally disposed oottom portion of said upper bowl.

38. The method of claim 34 wherein said media is molten metal.

39. The method of claim 38 wherein said molten metal is aluminum.

40. The method of claim 39 wherein said charge is aluminous scrap.

41. The method of claim 23 wherein the charge is a liquid.

42. The method of claim 23 wherein the charge is a semisolid.

43. The method of claim 23 wherein the media is comprised of multiphase liquids.

44. The method of claim 23 wherein said media is comprised of solid particles in a liquid.

45. The method of claim 23 wherein said media is comprised of immiscible liquid particles in a liquid.

46. An improved media circulator for submerged use in a system for submerging and entraining a charge in a media, said circulator comprising:

a rotatably driven vertical shaft secured to a horizontally disposed lower member which is provided with mechanical vane means to couple said lower member to a spaced apart horizontally disposed upper member which has a central opening through which said vertical shaft passes and said media is drawn as a result of said vertical shaft being driven, said upper and lower members disposed adjacent each other such that upon rotation of said vertical shaft said media is drawn vertically down into said central opening of said upper member, whereupon said media is divided into a first and a second portion, said lower member having openings therethrough adjacent said rotatably driven vertical shaft to thereby allow said first portion of said media to pass 1 through said openings in said lower member and flush from a region beneath said circulator any sinking objects that may be present, said second portion of said media being radially accelerated between said vane means and said upper and lower members to thereby establish in said media a circulation force.

47. The improved media circulator of claim 45 wherein said openings in said lower member are only positioned between said mechanical vane means at points adjacent to where said vertical shaft is secured to said lower member.

48. The improved media circulator of claim 46 wherein the number said openings are less than the number vane means.

49. The improved media circulator of claim 46 wherein the number of said openings is one half the number of said vane means.

50. The improved media circulator of claim 46 wherein the number of said openings equal the number of said vane means.

51. The improved media circulator of claim 46 wherein said co-operating configuration of said upper and lower members is of such a nature that when said vertical shaft is driven, said media is drawn vertically down into said central opening of said upper member and then redirected upwards at an angle from the horizontal.

52. The improved media circulator of claim 46 wherein said co-operating configuration of said upper and lower members is such that when said vertical shaft is driven said media is drawn vertically down into said central opening of said upper member and then redirected in a horizontally outward direction to thereby deliver said media into a molten mcdia circulation path.

* * * * *